US006079746A

United States Patent [19]

Olsen

[11] Patent Number: 6,079,746

[45] Date of Patent: Jun. 27, 2000

[54] SKI CONVERSION APPARATUS

[76] Inventor: Fred Olsen, Biskop Grimelunds VEI 21, Oslo, Norway

[21] Appl. No.: 08/897,940

[22] Filed: Jul. 21, 1997

[51] Int. Cl.[7] ..... A63C 5/06

[52] U.S. Cl. ..... 280/809; 280/609

[58] Field of Search ..... 280/601, 603, 280/608, 609, 7.13, 809, 814, 14.1; 36/100; 441/68; 403/314, 338, 381

[56] References Cited

U.S. PATENT DOCUMENTS

| | | | |
|---|---|---|---|
| 2,410,702 | 11/1946 | Arsenault | 36/100 |
| 2,549,534 | 4/1951 | Schultz | 280/608 |
| 2,735,519 | 2/1956 | Frischmann | 403/381 |
| 3,424,469 | 1/1969 | Hooker | 280/608 |
| 3,820,802 | 6/1974 | Davis | 280/601 |
| 4,006,912 | 2/1977 | Perlich et al. | 280/809 |
| 4,180,275 | 12/1979 | Montoya | 280/601 |
| 4,296,511 | 10/1981 | Wright | 441/68 |
| 4,895,388 | 1/1990 | Richmond | 280/601 |
| 4,906,016 | 3/1990 | Varan et al. | 280/608 |
| 5,360,228 | 11/1994 | Palau | 280/601 |
| 5,551,795 | 9/1996 | Engibarov | 403/381 |

FOREIGN PATENT DOCUMENTS

| | | | |
|---|---|---|---|
| 229608 | 7/1987 | European Pat. Off. | 280/809 |
| 2659562 | 9/1991 | France | 280/609 |
| 2835795 | 2/1980 | Germany | 280/809 |
| 3303158 | 8/1984 | Germany | 280/809 |
| 3425039 | 2/1986 | Germany | 280/809 |

*Primary Examiner*—J. J. Swann
*Assistant Examiner*—Frank Vanaman
*Attorney, Agent, or Firm*—Carmody & Torrance LLP

[57] ABSTRACT

Ski conversion apparatus for converting a cross-country ski to a downhill contoured ski. A tip shape modifier is attached to the tip section of the ski by expandable wedge assemblies and mating dovetails. A tail shape modifier is attached to the tail section of the ski by longitudinal dovetails and a detachable connection. The tip shape and tail shape modifiers are carried by the cross-country skier and attached to the cross-country skis when necessary to ski downhill in deep snow.

15 Claims, 5 Drawing Sheets

SKI CONVERSION APPARATUS

TECHNICAL FIELD

This invention relates to sport and recreational equipment and more particularly to snow skis.

BACKGROUND ART

Skiing is a popular winter sport and is generally divided into two categories-cross-country skiing (or touring) over level or relatively gentle slopes and downhill skiing over relatively steep or uneven terrain. Therefore, the ski equipment for the two types of skiing is different, cross country skis being relatively long, slender, of uniform width and light in weight, while downhill skis are shorter, wider and of heavier construction. A new type of advanced downhill ski assumes an hour glass shape, which is easier to maneuver during turns.

Cross-country skis are very effective for maneuvering in remote areas. However, if a cross-country skier climbs a hill and encounters virgin snow, the cross-country skis are not very good at floating on the snow surface. In fact, standard cross-country skis, which are narrow and of uniform width, tend to sink into fresh powder and have little control in deep snow.

The prior art has suggested various types of adapters or attachments for skis which enhance their operation for particular purposes or change the characteristics of the skis. Examples of this prior art are seen in the following U.S. Pat. Nos. 2,410,702 issued Nov. 5, 1946 to Arsenault; 3,820,802 issued Jun. 28, 1974 to Davis; 4,006,912 issued Feb. 8, 1977 to Perlich et al.; and 4,180,275 issued Dec. 25, 1979 to Montoya. None of these inventors have addressed the problem of skiing down hill over steep terrain or through fresh powder after climbing a hill on cross-country skis.

DISCLOSURE OF INVENTION

Briefly stated, the invention comprises apparatus for converting a cross-country ski to a downhill ski, the cross-country ski being of the type having a central section with means for attachment to a skier's boot, a tip section extending forwardly from the central portion and curving upwardly, and a tail section extending rearwardly from the central section, the central section, tip section and tail section together being of substantially the same width, said apparatus being characterized by first and second attachment means disposed on the tip section and tail section respectively, a tip shape modifier adapted to be attached to the first attachment means on the tip section and gradually increasing in width along a major part of the tip section toward the front of the ski, a tail shape modifier adapted to be attached to the second attachment means on the tail section, and gradually increasing in width along a major part of the tail section toward the rear of the ski, said tip shape modifier and said tail shape modifier being contoured so as to define, together with the ski central section, a generally hour-glass shape adapted for downhill skiing.

In the preferred embodiment the tip and tail shape modifiers are U-shaped and the skis and modifiers are provided with mating dovetail connections on their lateral sides. The tail shape modifier preferably includes a detachable connection strap which is held in a bracket mounted on the ski tail section.

BRIEF DESCRIPTION OF DRAWINGS

The invention will be better understood by reference to the following description, taken in connection with the accompanying drawings, in which.

BEST MODE FOR CARRYING OUT THE INVENTION

Figure 1:
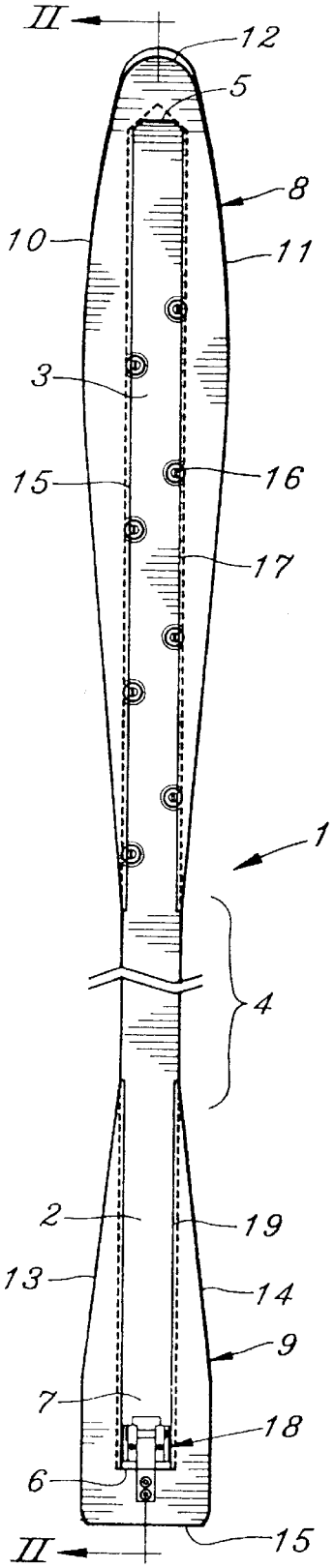
FIG. 1 is a plan view of a cross-country ski fitted with conversion apparatus according to the present invention, and omitting a part of the central section.
Figure 2:
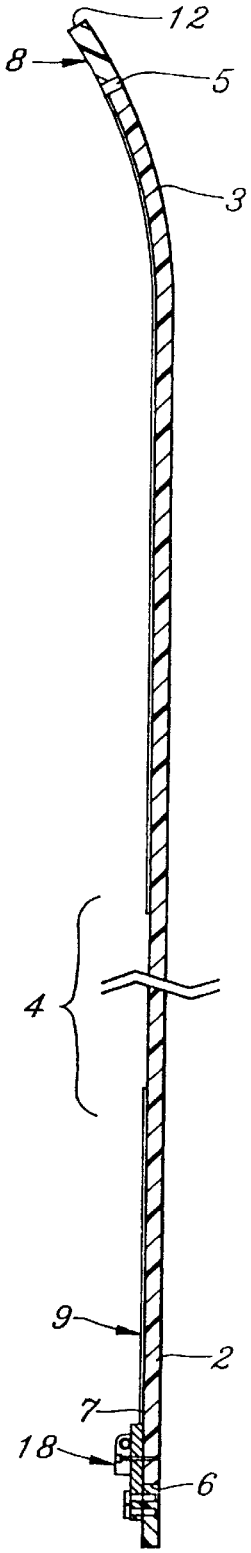
FIG. 2 is a side elevational view in cross-section taken along lines II—II of the ski and conversion apparatus of FIG. 1.

Referring now to FIGS. 1 and 2 of the drawing, a cross-country ski is shown fitted with the apparatus according to the present invention. The ski, shown generally at 1, includes a tail section 2, a tip section 3, and a central section 4. It will be understood by those skilled in the art that the complete central section 4 (only a portion of which is shown in the drawing) includes a binding adapted for attachment of the ski 1 to a skier's boot in the case of each of two skis. This detail is not shown, since this would greatly reduce the scale of the drawing in order to enable the full length of the ski to be shown. However, it will be understood that the central section 4 includes a binding (not shown) for a ski boot located near the center of ski 1. The tail section 2, central section 4, and tip section 3 are all of substantially uniform lateral width as is generally the case with a conventional cross-country ski. The end of tip section 3 is curved upwardly in a vertical plane terminating at a tip 5, whereas the tail section 2 is flat, terminating at a tail 6 to provide a platform area 7.

In accordance with the present invention, ski 1 is adapted to accommodate a tip shape modifier shown generally at 8 and a tail shape modifier shown generally at 9. The tip modifier 8 is generally U-shaped with side portions 10, 11 connected by front portion 12. Tip shape modifier 8 is curved upwardly in a vertical plane to correspond to the curvature of ski tip section 3. The sides 10, 11 of tip shape modifier 8 are contoured to gradually increase in width along a major part of the ski tip section 3 to a maximum about two-thirds of their length and then to decrease in width until joining with an end portion 12. Metal edges are provided along outer sides of the tip modifier 8 for providing "edging" action during skiing. These edges are preferably metal and are not unlike conventional edges provided on ski 1.

The tail shape modifier 9 is constructed in a similar manner as a U-shaped piece comprising side portions 13, 14 joined by an end portion 15. The tail shape modifier 9 is flat and the side portions 13, 14 increase gradually in width along a major part of the ski tail section 2 until they join with the end portion 15. Tail shape modifier 9 is provided with metal edges for promoting "edging" action during skiing.

The tip shape modifier 8 is adapted for attachment to the ski tip section 3 by means of screw actuated expandable wedge assemblies 16 and dovetail grooves 17 in a manner to be described. Similarly, the tail shape modifier 9 is supplied with a detachable connector 18 and dovetails 19 to be described in detail.

Figure 3:
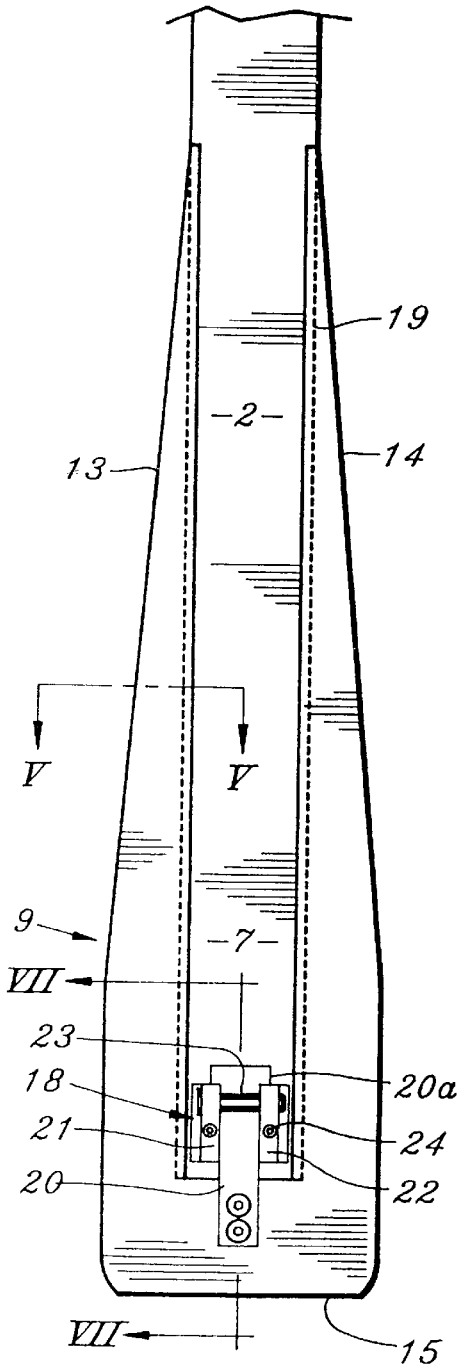
FIG. 3 is an enlarged plan view of the tail section of the ski with tail shape modifier.
Figure 5:
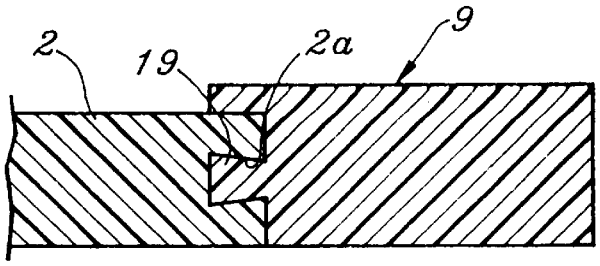
FIG. 5 is a cross sectional elevational view taken along lines V—V of FIG. 3.
Figure 7:
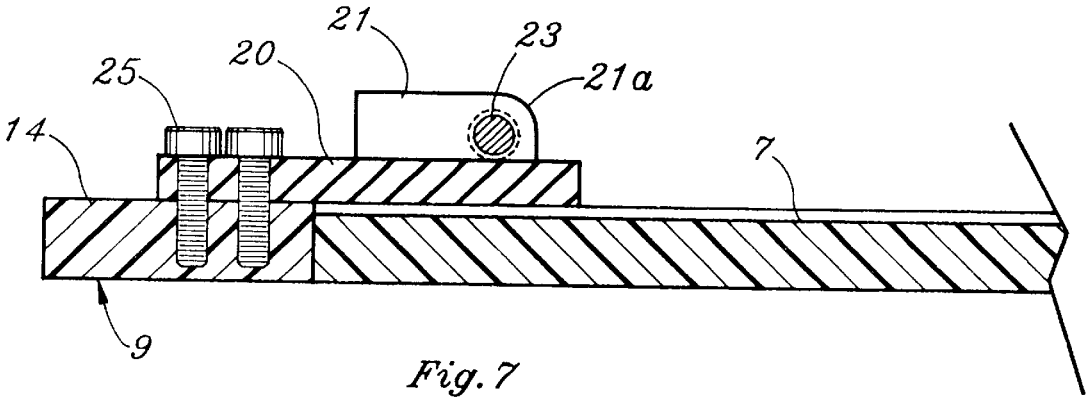
FIG. 7 is an enlarged cross-sectional elevational view taken along lines VII—VII of FIG. 3.

Referring to FIG. 3 of the drawing, together with the cross section view of FIG. 5, together with the cross sectional views of FIG. 5 and FIG. 7, the tail shape modifier 9 is shown to be slightly thicker than tail section 2 of the ski and is longitudinally supported along tail section 2 by means of a dovetail 19 seen most clearly in FIG. 5, which is longitudinally insertable into a corresponding dovetail slot 2*a* on the lateral side of the tail section 2 of the ski. The detachable connector 18 consists of two separable parts, a bracket mounted on the platform 7 of the ski, and a flexible elastomeric retainer strap 20 attached to the rear portion 15 of the tail shape modifier 9. The bracket consists of a pair of upstanding sidewalls 21, 22 drilled to receive a removable retainer pin 23, and attached by bolts 24 to platform 7. The flexible retainer strap 20 extends between sidewalls 21, 22 and then has a wider section 20*a* which prevents longitudinal withdrawal of the strap 20 from between the sidewalls 21, 22. A preferable material for strap 20 is rubber of 100 durometer.

Referring to the enlarged cross sectional view of FIG. 7, the two upstanding sidewalls, one of which is seen at 21, each include a radius as shown at 21*a* to facilitate positioning of retainer strap 20. The retainer strap is attached to the tail shape modifier 9 by means of bolts 25.

Figure 4:
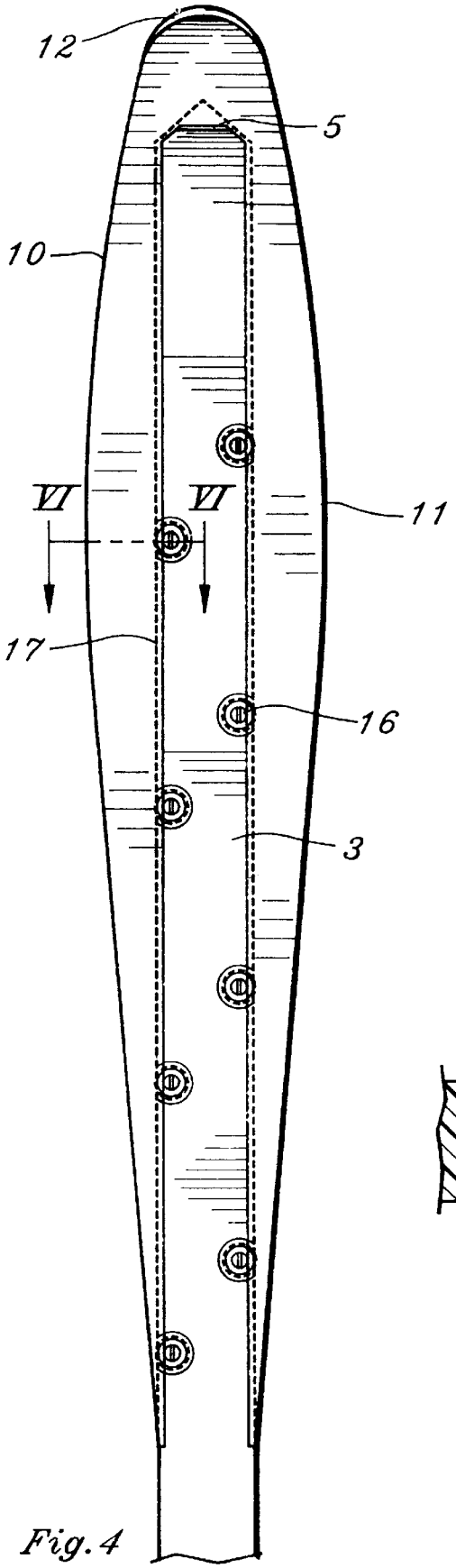
FIG. 4 is an enlarged plan view of the tip section of the ski with tip shape modifier.
Figure 6:
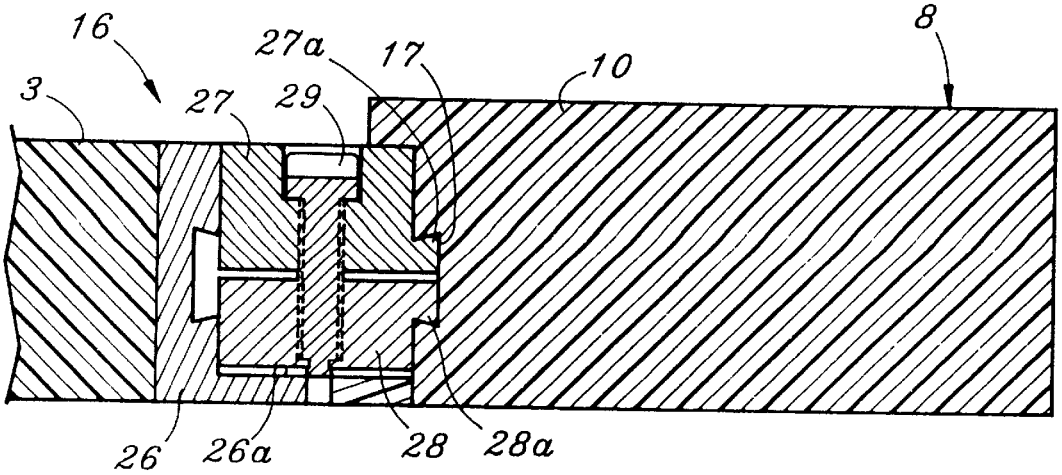
FIG. 6 is a cross-sectional elevational view taken along lines VI—VI of FIG. 4.

Referring now to the tip shape modifier shown in FIG. 4, together with the cross sectional view shown in FIG. 6, modifier 8 is slightly thicker than the tip section 3 of the ski and includes a dovetail slot 17. Because the ski tip curves in a vertical plane, a special expandable wedge assembly 16 is employed. Wedge assemblies 16 are staggered and disposed along the length of the tip section 3 as shown in FIG. 4.

Referring to FIG. 6 of the drawing, the details of one of the wedge assemblies 16 is shown. A semi-circular metal carrier 26 contains a recess 26*a* housing metal wedging members 27, 28, each fitted with a half-dovetail extension 27*a*, 28*a* respectively. Wedging members 27, 28 each have a central hole, one with a left hand thread and one with a right hand thread receiving a mating bolt 29. Rotation of bolt 29 causes the two wedging members 27, 28 to move in opposite directions from one another so as to either grip or to release the dovetail slot 17 of the tip shape modifier 8. The wedge assemblies 16 are preferably made of aluminum and bonded with adhesive into the lateral side of tip section 3. Alternatively, wedge assemblies 16 can be made from any metal, plastic or other material suitable for providing the desired holding power (of tip shape modifier 8 to ski 1) and dynamic response under skiing conditions can be used.

Operation of the invention should be easily understood. When it is desired to convert the ski 1 from a cross-country ski to a downhill ski, the tip and tail shape modifiers 8, 9 are attached. The tip shape modifier 8 is attached by placing it over the tip section 3 and, with a suitable tool, tightening each of the wedge assemblies 16. The tail shape modifier 9 is attached by longitudinally sliding the two side parts 13, 14 in a forward direction from the rear of the ski by means of the dovetail slots 19 until the tail of the ski 6 abuts the end of modifier 9. Retainer pin 23 is removed and the flexible retainer strap 20 is stretched and pushed down between walls 21, 22, aided by the radius 21*a* on each of the walls, until the enlarged portion 20*a* of the strap is secured. Then the retainer pin 23 is replaced.

MODIFICATIONS

Figure 8:
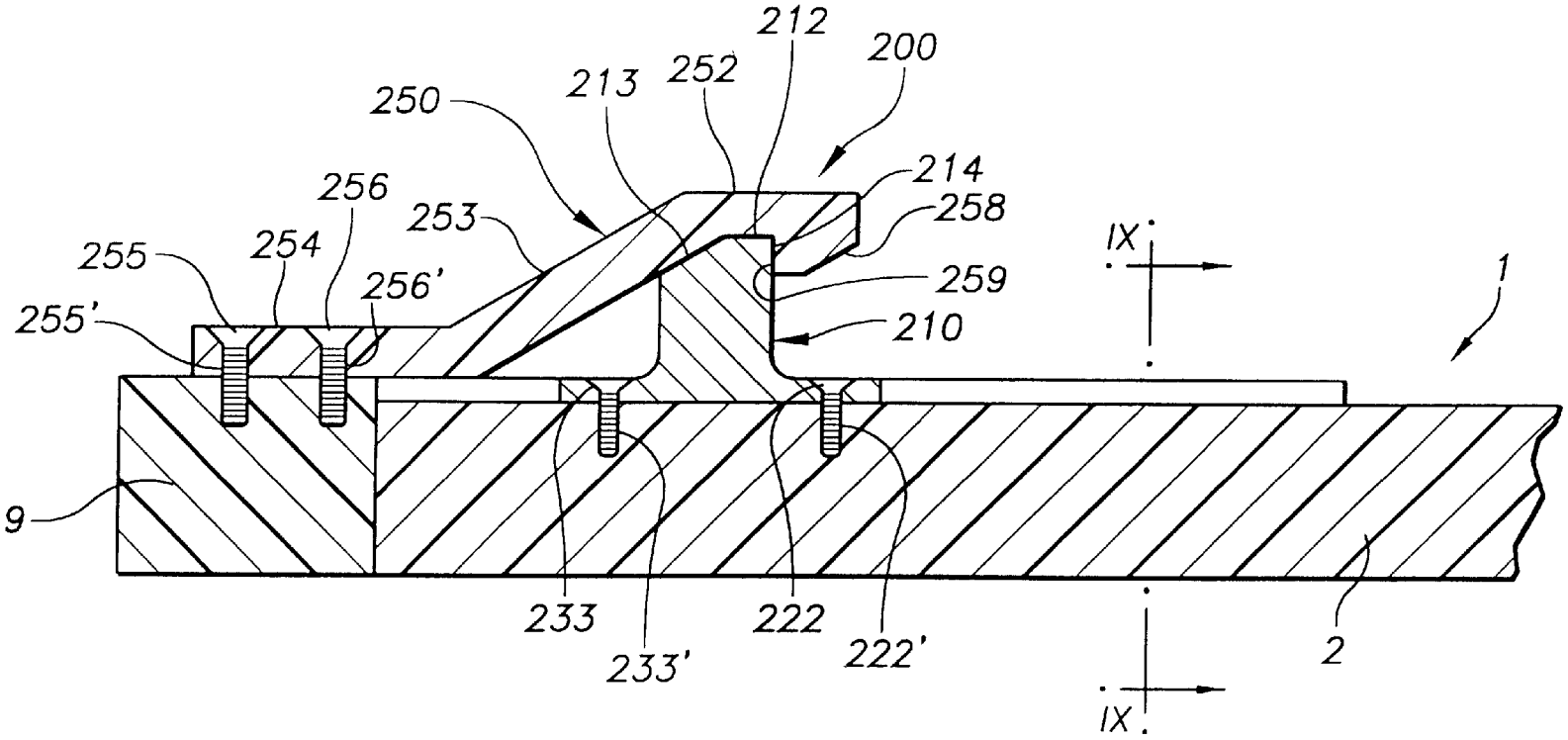
FIG. 8 is a partial side elevational view in cross section of a modified tail shape modifier attachment.
Figure 9:
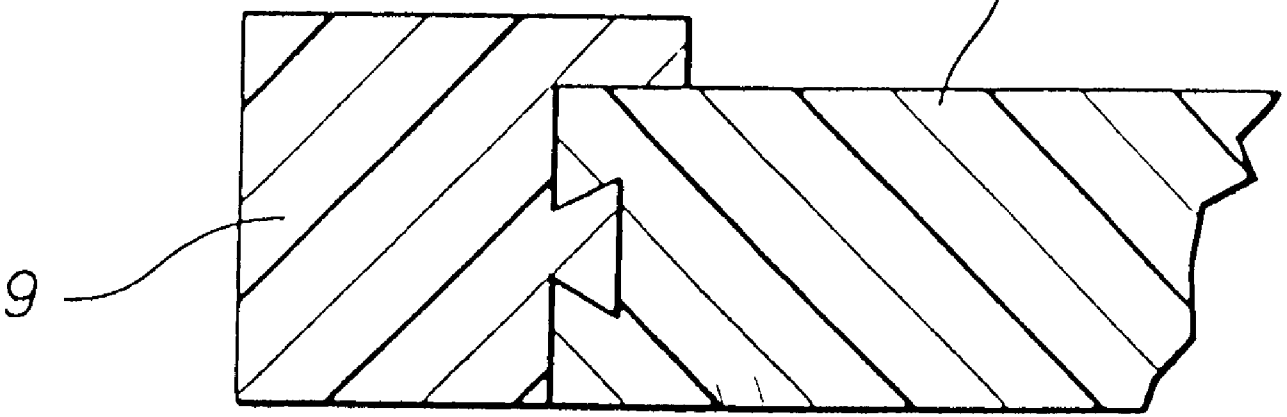
FIG. 9 is a partial end elevational view in cross section of the FIG. 8 modification.

Another mechanism for attaching tail shape modifier 9 to ski 1 is shown in FIGS. 8 and 9, which show cross sections of this invention taken along the length and width, respectively, of the ski. As shown in FIG. 8, a latch assembly 200 for attaching tail modifier 9 to ski 1 comprises an upstanding male latch member 210 and a female flexible latch member 250. Male latch member 210 has a top side 212 that is chamfered 213 along the tail side of the ski and has a leading side 214. Male latch member 210 defines screw holes 222' and 233' along front and tail portions that allow the male latch member to be easily attached to ski 1 preferably with flathead screws 222 and 233.

Female latch member 250 has a head section 252, a neck section 253 and a tail section 254. Head section 252 of the female latch member defines a chamfered bottom surface 258 and a locking inside surface 259. Flathead screws 255, 256 extending through openings 255', 256', respectively, defined in the tail section of the female latch member 250 attach the female latch member 250 to the ski. Female latch member 250 is preferably made from Delrin® material so as to allow the latch member to be strong and yet to flex easily vertically, a feature that facilitates the sliding of the female latch member over the male latch member as described below.

As shown in FIG. 9, the facing sides of ski 1 and tail modifier 9 are provided with female and male surfaces respectively, for mating the sides of the ski and tail modifier in a dove tail fashion.

To assemble the tail shape modifier 9 to the ski 1, the tail modifier is slipped along the ski using the dovetail connection surfaces along the facing sides of the tail modifier and the ski. As female latch member 250 contacts male latch member 210, chamfered surface 258 of female latch member 250 is caused to flex vertically outwardly by chamfered surface 213 of the male latch member 210 so as to permit tail member 9 to contact the trailing edge 10 of the ski. At this point, inside surface 259 of the head section 252 of the female latch member 250 is allowed to clip in place along leading edge 214 of the male latch member 210 providing for tight holding between male and female latch members and so of the tail modifier 9 to the ski 1.

As an example of another mechanism for effecting attaching engagement of tip shape modifier 8 to ski 1, the screw 29 of wedge assembly 16 seen in FIG. 6 can be replaced with a cam piece. For example, the Cam piece may have a head member provided with a handle, and a body. Along a mid-point of the outer surface of the cam body is a pin retained by a circumferential groove in the body of ski 2. The cam piece has a bottom surface which is so beveled as to provide a cam surface.

In this arrangement, modified forms of top wedge member 27 and bottom wedge member 28 of FIG. 6 are included wherein the cam piece slips into an opening the top wedging member. Bottom wedging member further defines a stepped region. Stepped region has a top surface. Below bottom wedge is a spring.

The turning of the cam piece inside the top wedging member causes the beveled bottom surface of the cam piece to rotate such that the cam piece moves against the stepped region of the bottom wedging member so that the bottom wedging member is forced outwardly from the top wedging member. By forcing the bottom wedging member outwardly from the top wedging member, the cam piece establishes the dovetail connection between the tip shape modifier 8 and the tip section 3 of the ski 1. When the handle is turned in the opposite direction spring returns the bottom wedge to its unlocked position. It will be appreciated that use of a cam piece in place of screw 29 as just described allows for easy and ready attachment of tip member to the ski without the need to use a screw driver or allen wrench to effect the screw rotation.

INDUSTRIAL APPLICABILITY

The tip shape modifier 8 and tail shape modifier 9 are relatively short and can be carried in a backpack. They do not impede the enjoyment of cross-country skiing, but are available for easy attachment when the skier wishes to traverse a steep downhill slope or ski through fresh powder, over ice, or under other snow terrain conditions. The enhanced hour-glass shape facilitates the downhill skiing.

While the preferred embodiment shows the wedge assemblies attached to the tip section and arranged to expand in dovetail slots in the tip shape modifier, the arrangement can be reversed with the wedge assemblies disposed in the tip shape modifier and arranged to expand in dovetail slots in the lateral edges of the tip section.

While the preferred embodiment shows the bracket disposed on the tail section of the ski and the flexible retainer strap attached to the tail shape modifier, the arrangement can be reversed with the bracket mounted on the tail shape modifier and the flexible strap attached to the tail section of the ski. Also the dovetail slots and dovetail extensions can be reversed.

The methods of attachment of the tip and tail shape modifiers for the ski are only illustrative of other suitable attachment types. While there has been shown what is considered to be the preferred embodiment of the invention, other modifications will become apparent to those skilled in the art and it is desired to cover such modifications in the appended claims.

I claim:

1. Apparatus for use in cooperation with a ski, the ski having a central section, a tip section extending forwardly from the central portion and curving upwardly, and a tail section extending rearwardly from the central section; the central section, the tip section and the tail section together forming a continuously smooth bottom surface of the ski having substantially the same width, said apparatus comprising:

a tip shape modifier coupleable to the tip section, said tip shape modifier for gradually increasing the width of the bottom surface of the ski along a major part of the tip section toward the front of the ski, and a tail shape modifier coupleable to the tail section, said tail shape modifier for gradually increasing the width of the bottom surface of the ski along a major part of the tail section toward the rear of the ski, wherein said ski has an hour-glass shape and a continuous smooth bottom surface and is converted from a cross-country ski to a downhill ski when said tip shape modifier and said tail shape modifier are respectively coupled to the tip section and the tail section.

2. A multi-purpose ski, the ski comprising:

a central section, a tip section integrally formed with and extending forwardly from the central portion and curving upwardly, and a tail section integrally formed with and extending rearwardly from the central section; the central section, the tip section and the tail section together forming a continuously smooth bottom surface and all having a substantially equal width; and a conversion apparatus, the conversion apparatus comprising a tip shape modifier coupleable to the tip section, the tip shape modifier for gradually increasing the width of the bottom surface of the tip section along a major part of the tip section toward a front end thereof; and a tail shape modifier coupleable to the tail section, the tail shape modifier for gradually increasing the width of the bottom surface of the tail section along a major part of the tail section toward a rear end thereof;

wherein the multi-purpose ski has an hour-glass shape and a continuous smooth bottom surface and is converted from a cross-country ski to a downhill ski when the tip shape modifier and the tail shape modifier are coupled to the tip section and the tail section, respectively.

3. The multi-purpose ski according to claim 2, wherein the tip section includes attachment means comprising a plurality of expandable wedge assemblies disposed along the lateral sides of the tip section, and wherein the tip shape modifier includes dovetail slots along its lateral sides adapted to receive portions of said wedge assemblies.

4. The multi-purpose ski according to claim 3, wherein said wedge assemblies comprise a pair of screw actuated, oppositely threaded wedging members.

5. The multi-purpose ski according to claim 3, wherein said wedge assemblies are made of aluminum and bonded with adhesive into the lateral sides of said tip section.

6. The multi-purpose ski according to claim 2, wherein the tail section includes attachment means comprising a bracket mounted on the tail section and a flexible strap detachably connectable to said bracket for holding the tail shape modifier to the tail section.

7. The multi-purpose ski according to claim 6, wherein said attachment means further comprises a dovetail slot along the lateral sides of the tail section, and wherein the tail shape modifier includes a mating dovetail projection.

8. The multi-purpose ski according to claim 2, wherein the tail shape modifier is generally U-shaped and has a greater thickness than the tail section.

9. The multi-purpose ski according the claim 2, wherein the tip shape modifier is generally U-shaped and has a greater thickness than the tip section.

10. A multi-purpose ski, comprising:

an elongated member having a first upturned end including dovetail projections along lateral sides of said first end, a center portion integral with the first upturned end, and a second end integral with the center portion, the second end including dovetail slots along lateral sides thereof, wherein said first upturned end, said center portion and said second end form a continuously smooth bottom surface having substantially the same width;

a first adapter having dovetail slots for receiving said dovetail projections of said first upturned end and for detachably coupling said first adapter to said first upturned end, said first adapter gradually increasing said width of said bottom surface of said first upturned end along a major part of said first upturned end in a direction away from said center portion; and a second adapter having dovetail projections for detachably coupling said second adapter to said second end, said second adapter gradually increasing said width of said bottom surface of said second end along a major part of said second end in a direction away from said center portion;

wherein when said first adapter and said second adapter are respectively coupled to the first upturned end and the second end, the ski maintains said continuously smooth bottom surface and, together with said central portion, define an hour-glass shape.

11. The multi-purpose ski as set forth in claim 10, wherein said dovetail projections of said first upturned end are comprised of a plurality of expandable wedge assemblies.

12. The multi-purpose ski as set forth in claim 11, wherein said wedge assemblies are comprised of a pair of screw actuated, oppositely threaded wedging members.

13. The multi-purpose ski as set forth in claim 10, wherein said second adapter further comprises a flexible retainer strap disposed on said second adapter and said second end comprises means for receiving and for preventing longitudinal withdrawal of said retainer strap.

14. The multi-purpose ski as set forth in claim 13, wherein said means for receiving and for preventing is comprised of a retainer pin and a bracket having side walls for receiving said retainer strap therebetween, said walls further receiving said retainer pin such that said retainer pin prevents withdrawal of said retainer strap from between said side walls.

15. A multi-purpose ski as set forth in claim 13, wherein said retainer strap includes a head section having a bottom locking surface and wherein said means for receiving and for preventing is comprised of an upstanding member having a leading edge facing opposite said second adapter, wherein when in a coupled position said leading edge of said upstanding member receives and retains said bottom locking surface of said retainer strap for preventing said longitudinal withdrawal of said retainer strap.

* * * * *